US005675868A

United States Patent [19]

Ferguson et al.

[11] Patent Number: 5,675,868

[45] Date of Patent: Oct. 14, 1997

[54] LATCHING DEVICE FOR A DOOR OF A RAILWAY TRAIN STOP HOUSING

[75] Inventors: Ross Edward Ferguson, Irwin; Glen John Siefert; Mike Edward Sterling, both of Pittsburgh, all of Pa.

[73] Assignee: Union Switch & Signal Inc., Pittsburgh, Pa.

[21] Appl. No.: 720,936

[22] Filed: Oct. 4, 1996

[51] Int. Cl.[6] ..... E05D 15/50

[52] U.S. Cl. ..... 16/230; 16/82

[58] Field of Search ..... 16/230, 231, 232, 16/321, 324–328, 83, 85, 82, DIG. 17

[56] References Cited

U.S. PATENT DOCUMENTS

| | | | |
|---|---|---|---|
| 661,845 | 11/1900 | Brye et al. | 16/327 |
| 2,249,294 | 7/1941 | Kohler | 16/82 |
| 2,462,268 | 2/1949 | Kahl | 16/328 |
| 2,890,478 | 6/1959 | Young | 16/326 |
| 3,862,774 | 1/1975 | Johnson | 16/82 |
| 4,159,837 | 7/1979 | Morita | 16/85 |
| 4,602,889 | 7/1986 | Mu-shan | 16/332 |

*Primary Examiner*—Chuck Y. Mah
*Attorney, Agent, or Firm*—Kevin A. Sembrat

[57] ABSTRACT

A latching device is provided for releasably retaining in an upright and open position, a hinged door which is typically manufactured of a heavy cast iron and hinged to a train stop housing, thereby to prevent the unintentional and accidental closure of the hinged door during installation connections or any field operational maintenance of the train stop housing. Preferably, a latch assembly is mounted atop a sturdy frame which provides an integral support above the train stop housing and is mountable with mounting hardware to a mounting lug of the train stop housing. The latch assembly includes a covered latching bar which slides in a channel defined by a first and second bracket and is urged by a spring mounted between the first and second bracket, thereby to urge a latch end of the latching bar outwardly away from the latch assembly and an opposing handle end of the latching bar inwardly towards the latch assembly. The latching device is mounted to the train stop housing so that a hinged door which is rotated toward the integral support of the frame slides against the latch end and urges the latch end inwardly toward the latch assembly against the urging of the spring, until the door is moved past the latch end and the spring snaps the latch end outwardly away from the latch assembly, thereby to obstruct the door from unintentionally and accidentally being closed past the latch end, so that the door is positioned between the latch end and the support of the frame. When closing of the door is desired, the handle end of the latching bar may be manually grasped, thereby to urge the handle end outwardly away from the latching assembly and to retract the latch end inwardly towards the latch assembly to clear the latch end obstruction which prevents closing of the door.

15 Claims, 13 Drawing Sheets

LATCHING DEVICE FOR A DOOR OF A RAILWAY TRAIN STOP HOUSING

BACKGROUND OF THE INVENTION

1. Field of the Invention

The present invention relates generally to a latching device and, more particularly, to a latching device for releasably retaining a hinged door of a train stop housing in an upright and open position.

2. Description of the Related Art

In the related art, an apparatus known as a "train stop" is typically mounted between or alongside the rails of a railway line and operates to mechanically stop a manually controlled railway vehicle in the event the driver incorrectly proceeds through a stop signal. FIGS. 1, 2, 3 show a side view, a cutaway top view, and a rear view, respectively, of the exterior of a train stop known as an EM-1 train stop, typically manufactured by Union Switch & Signal Inc., in accordance with the prior art. A housing 100 includes mounting lugs 102 and 104 thereby to fixedly mount the housing between or alongside the rails to either railroad ties (not shown), a bench bracket (not shown) known in the art, or other mounting surface known in the art. A crank connection 106 extends through the housing 100 and protrudes therefrom on both sides, thereby to provide connection means for mechanical apparatus associated with mechanically stopping the railway vehicle. An air vent 108 provides air circulation to the interior of the housing 100. A door 110 is pivotally hinged to the housing 100 with a hinge pin 112. The door 110 may be locked in the closed position with a lockable clasp 111.

As is well known in the art, the door 110 may be rotated about the hinge pin 112 from the closed position shown in FIGS. 1–3 to a partially open position shown by a phantom door 113 and even to a fully open position wherein the door 110 rests on the ground (not shown). However, sometimes the housing 100 is mounted so that a concrete pillar (not shown) or other obstacle obstructs the door 110 from being rotated about the hinge pin so that the door 110 rests on the ground, and instead the door 110 rests in an upright position shown by the phantom door 113 against the concrete pillar or other obstacle. In this partially open position, an unintentional or accidental bumping of the door 110 may cause the door 110 to slam shut atop the housing 100. Since the door 110 is typically manufactured of a heavy cast iron, an unexpected slamming shut of the door 110 could cause serious damage or injury to the hands or body of personnel performing installation connections or field operational maintenance inside of the housing 110.

Consequently, a need has been felt for providing a safety latch for releasably latching the door 110 in an upright open position, thereby restricting the hinged door 110 from unintentional closure during installation or field operational maintenance until the door 110 is intentionally unlatched to be closed.

SUMMARY OF THE INVENTION

It is therefore an object of the present invention to provide a latching device for releasably retaining a hinged door of a train stop housing in an upright and open position.

It is a feature of the present invention to provide a spring-tensioned latch for releasably retaining a hinged door in an open position.

It is another feature of the present invention to provide a reinforced support for supporting the weight of the heavy cast iron door when the door is latched in an open position.

It is another feature of the present invention to provide a handle for manually releasing the latch which retains the door from unintentionally falling closed.

It is another feature of the present invention to provide a frame with an integral reinforced support for mounting a latch assembly and the reinforced support a predetermined height above a train stop housing.

Briefly described according to one embodiment of the present invention, a latching device is provided for releasably retaining a hinged door of a train stop housing in an upright and open position, comprising: a latch assembly defining a latch channel, mountable to the train stop housing; a frame for mounting the latch assembly to the train stop housing; a door support integral to the frame for supporting the hinge door in the upright and open position; and releasable latch means operatively arranged to slide within the latch channel for releasably retaining the hinged door in an upright and open position.

Another preferred embodiment of the present invention is a latching device having a latch assembly mounted atop a mounting frame including a reinforced support portion. The latch assembly includes a latching bar having a latch end and a handle end. The latching bar is operatively arranged to slide within brackets of the latch assembly and is spring tensioned thereby to urge the latch end outwardly away from the latch assembly and to urge the handle end inwardly towards the latch assembly. The latch end has a rounded side and an opposing flat latching side. The rounded side of the latch slides alongside a door which is rotated towards the rounded side thereby to urge the protruding latch inwardly against the spring tensioning to permit the door to be rotated beyond the rounded end of the latch. The latch end of the spring tensioned latching bar is urged outwardly away from the latch assembly when the door is rotated beyond the latch end and is positioned between the latch end and the reinforced support that is integral to the frame. In this position, the door is retained between the reinforced support and the latch end. The handle end may be grasped thereby to manually urge the handle end outwardly away from the latch assembly against the tension of the spring which urges the handle inwardly toward the latch assembly. Urging the handle end outwardly away from the latch assembly moves the latch end inwardly towards the latch assembly, thereby permitting clearance for the door to be rotated to a closed position. The frame of the latching device is preferably mounted with mounting hardware to an external mounting lug which is integral to the housing.

An advantage of the present invention is that unintentional and accidental closing of the heavy cast iron door of the train stop is eliminated.

Another advantage of the present invention is the door of the train stop is latched merely by rotating the door alongside and past the latch end.

Another advantage of the present invention is that a latched door may be unlatched by manually operating a handle end.

A further advantage of the present invention is that performing installation connections or operational maintenance to the inside of the train stop housing is made safer when the door of the housing is retained in an upright and open position to prevent accidental or unintentional closing of the door upon the housing.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
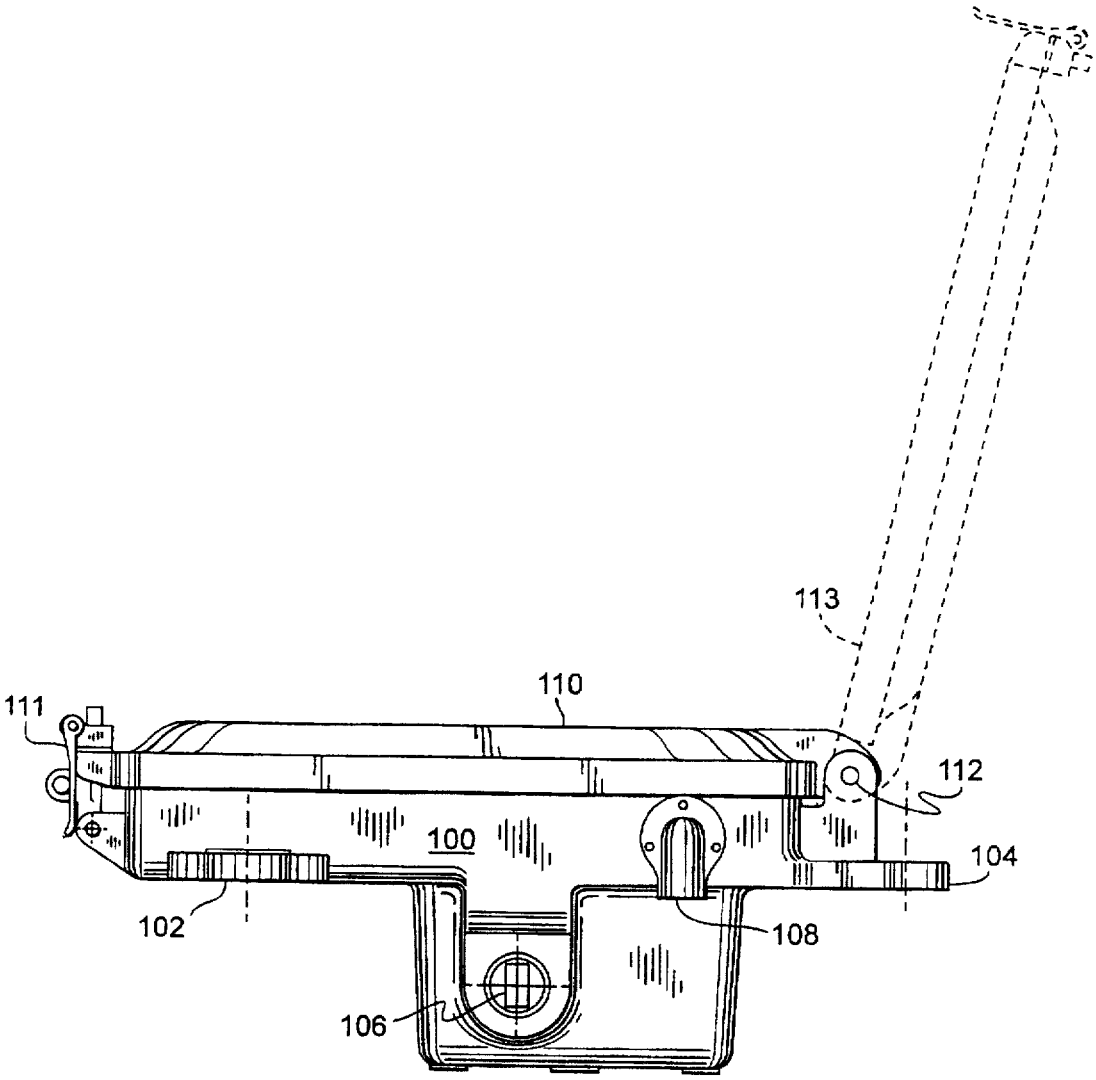
(PRIOR ART) Fig. 1
FIG. 1 is a side view of a train stop housing and hinged door in accordance with the prior art.
Figure 2:
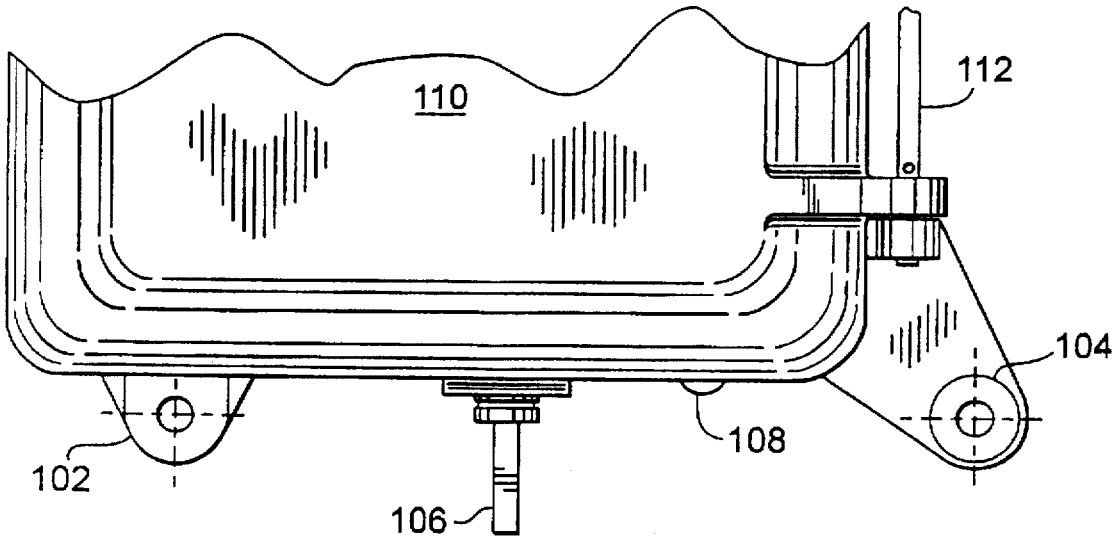
(PRIOR ART) Fig. 2
FIG. 2 is a cutaway top view of the train stop housing and the door of FIG. 1 in accordance with the prior art.
Figure 3:
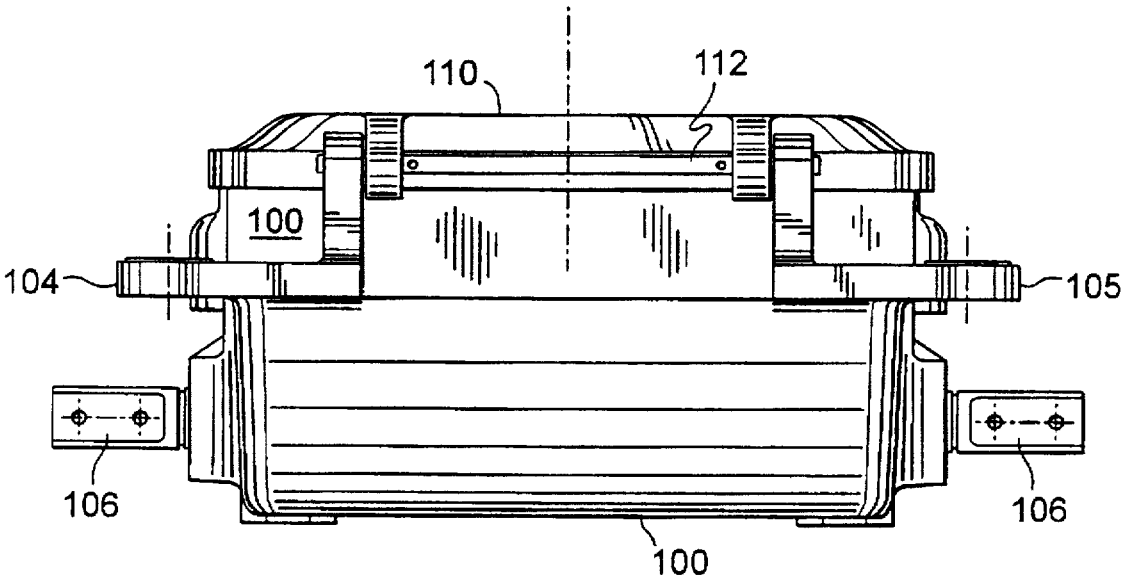
(PRIOR ART) Fig. 3
FIG. 3 is a rear view of the train stop housing and hinged door of FIG. 1, in accordance with the prior art.
Figure 4:
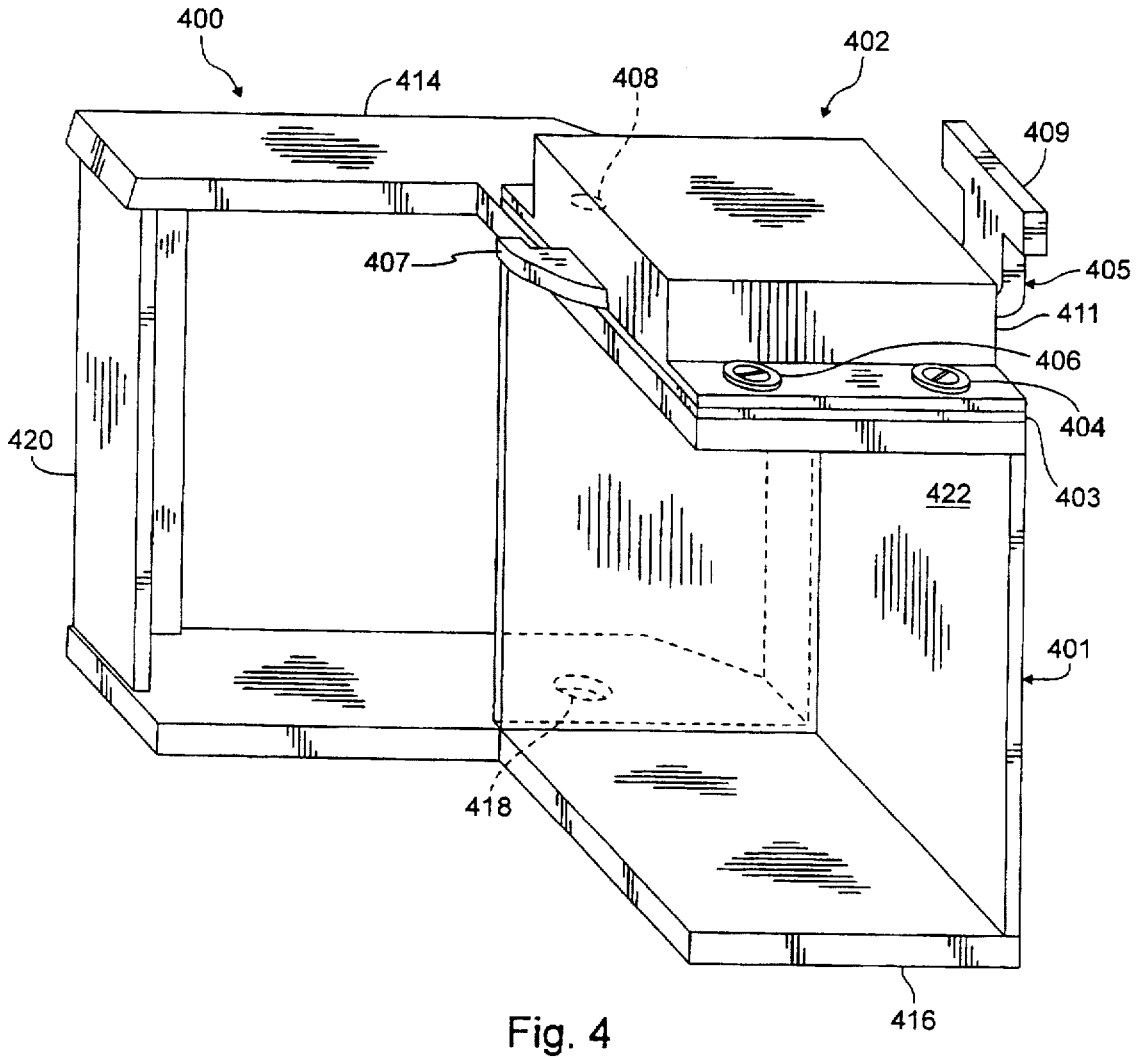
FIG. 4 is a perspective view of a latching device including a latch assembly mounted atop an L-shaped frame with a reinforced support, in accordance with the present invention.

Referring now to FIG. 4, a latching device 400, comprising a frame 401 and a latch assembly 402, is shown according to the present invention. The latch assembly 402 comprises a bottom plate 403, and a latching bar 405 having a latch end 407 and a handle end 409 which are both preferably integral to the latching bar 406. A cover 411 is mounted above the latching bar 405 so that the latch end 407 and the handle end 409 each protrudes outwardly therefrom. The latching bar 405 is tensioned by a spring (refer to FIG. 6), thereby to urge the handle end 409 inwardly towards the cover 411 and to urge the latch end 407 outwardly away from the cover 411.

In a preferred embodiment, the cover 411 is mounted, preferably with screws 404, 406, 408, and 509 (see FIG. 5), through the bottom plate 403 to the frame 401. In another preferred embodiment, the cover 411 is mounted, preferably with the screws 404, 406, 408, and 509 (see FIG. 5), to the bottom plate 403.

Figure 6:
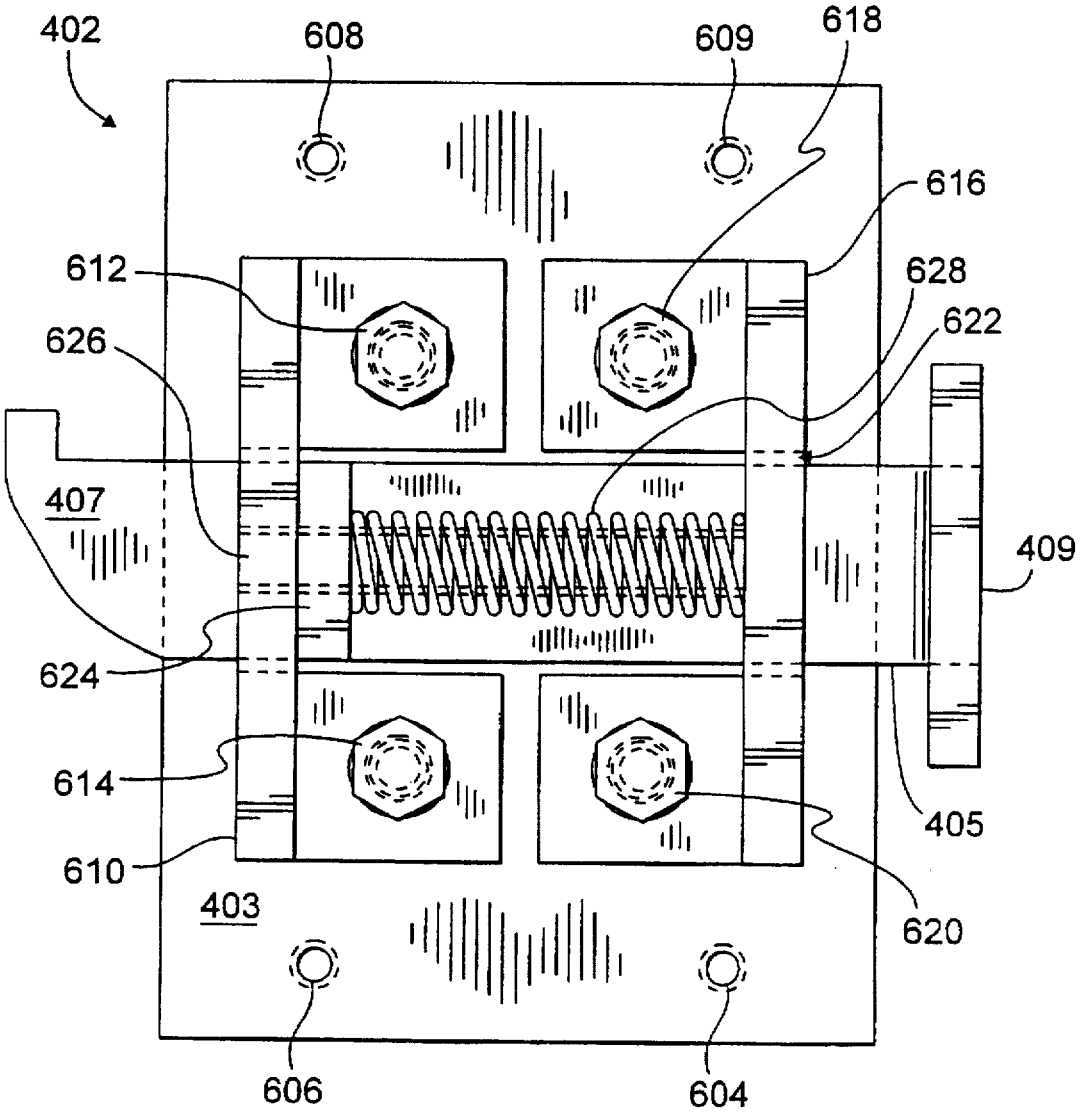
FIG. 6 is a top view of the latch assembly of FIG. 5 with the cover removed.

The latch assembly 402 is mounted through the bottom plate 403 to the frame 401 (refer to FIGS. 4 and 6). The frame 401 preferably is L-shaped, having a top portion 412 which defines a support portion 414 and a bottom portion 416 which defines a mounting orifice 418. The frame 401 preferably is formed by welding an angle bracket 420 and a T-shaped bracket 422 between the top portion 412 and the bottom portion 416. The brackets 420 and 422 provide necessary form and strength to the frame 401 while minimizing weight of the latching device 400.

In a preferred embodiment, the frame 401 is mounted to the housing 100 so that the hinge pin 112 is between the latch end 407 and the support portion 414 (see FIG. 9) but below the support portion 414 by a predetermined height which ranges from three to six inches (7.60 to 15.24 centimeters), with a preferable predetermined height of 4.5 inches (11.5 centimeters).

In a preferred embodiment, the support portion 414 is integral to the top portion 412. In another preferred embodiment, the support portion 414 is reinforced to support additional weight of a door manufactured of heavy cast iron.

Figure 5:
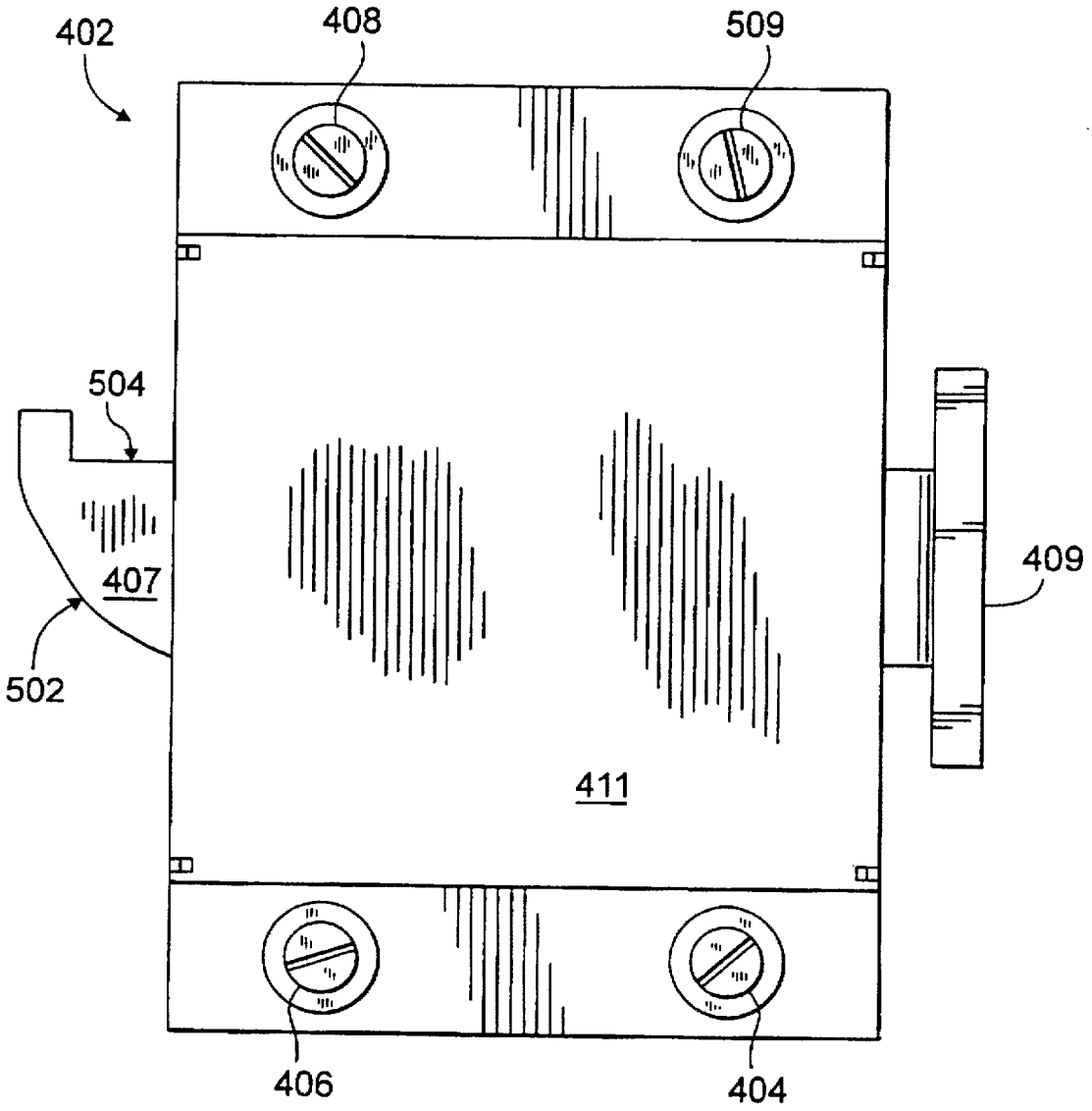
FIG. 5 is a top view of a latch assembly with a cover in accordance with the present invention.

FIG. 5 is a top view of the latch assembly 402 showing the cover 411, the latch end 407, the handle end 409 and mounting screws 404, 406, 408, and 509. In a preferred embodiment, the latch end 407 has a rounded side 502 and a flat side 504. The rounded side 502 faces away from the support portion 414 of FIG. 4, and the flat side 504 faces towards the support portion 414 of FIG. 4.

Figure 7:
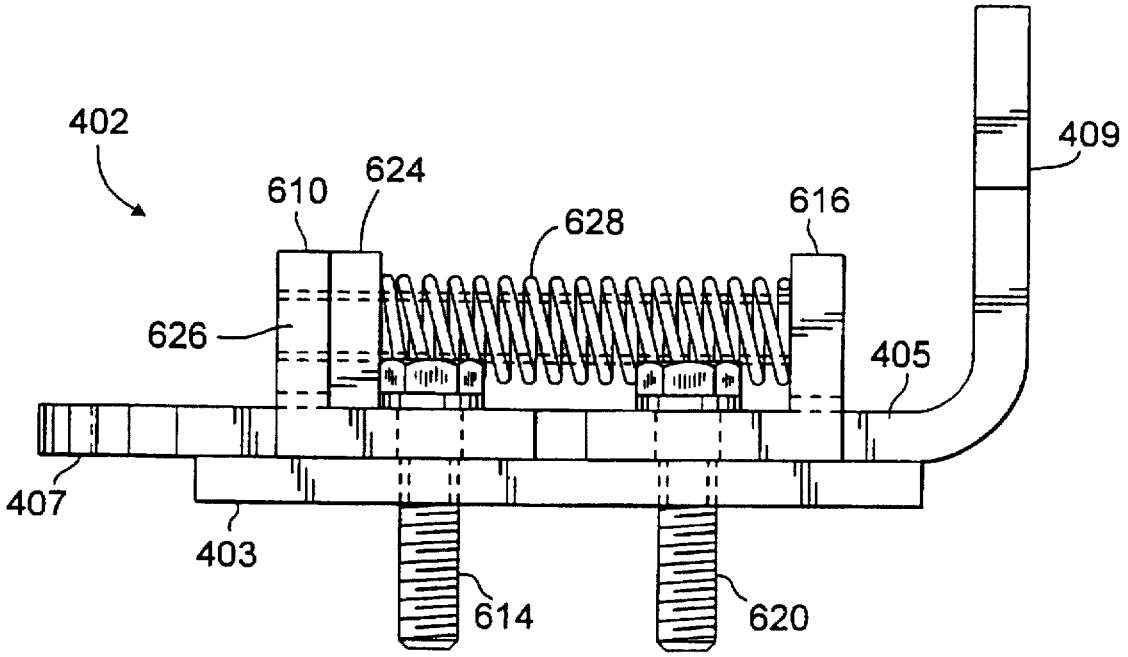
FIG. 7 is a side view of the latch assembly of FIG. 6.

FIG. 6 shows a top view of the latch assembly 402 with the cover 411 shown in FIG. 5 removed therefrom, and FIG. 7 is a side view of the latch assembly 402 shown in FIG. 6. The bottom plate 403 has mounting orifices 604, 606, 608, and 609 through which the screws 404, 406, 408, and 509 are respectively inserted for mounting the cover 411 to the bottom plate 403.

A first bracket 610 is fixedly mounted with bolts 612 and 614 to the bottom plate 403. A second bracket 616 is fixedly mounted with bolts 618 and 620 to the bottom plate 403. The bolts 612, 614, 618 and 620 extend through the bottom plate 403 and are used to mount the latch assembly 402 to the top portion 412.

The latching bar 428 is operatively arranged to slide atop the bottom plate 403, within a channel 622 defined beneath and between the first bracket 610 and the second bracket 616. A stop 624 is integral to the latching bar 405 and protrudes upwardly to rest against the first bracket 610 when the latch end 407 fully protrudes from the latch assembly 402. A rod 626 is mounted above the latching bar 405 between the first bracket 610 and the second bracket 616. A spring 628 mounted around the rod 626 between the stop 624 and the second bracket 616 presses against the second bracket 616 and the moveable stop 624, thereby urging the stop 624 and the integral latch end 407 on the latching bar 405 away from the second bracket 616. The handle end 409 may be grasped to urge the stop 624 against the spring 628 and towards the second bracket 616, thereby to move the handle end 409 outwardly away from the latch assembly 402, and to retract the latch end 407 into the latch assembly 402.

Figure 8:
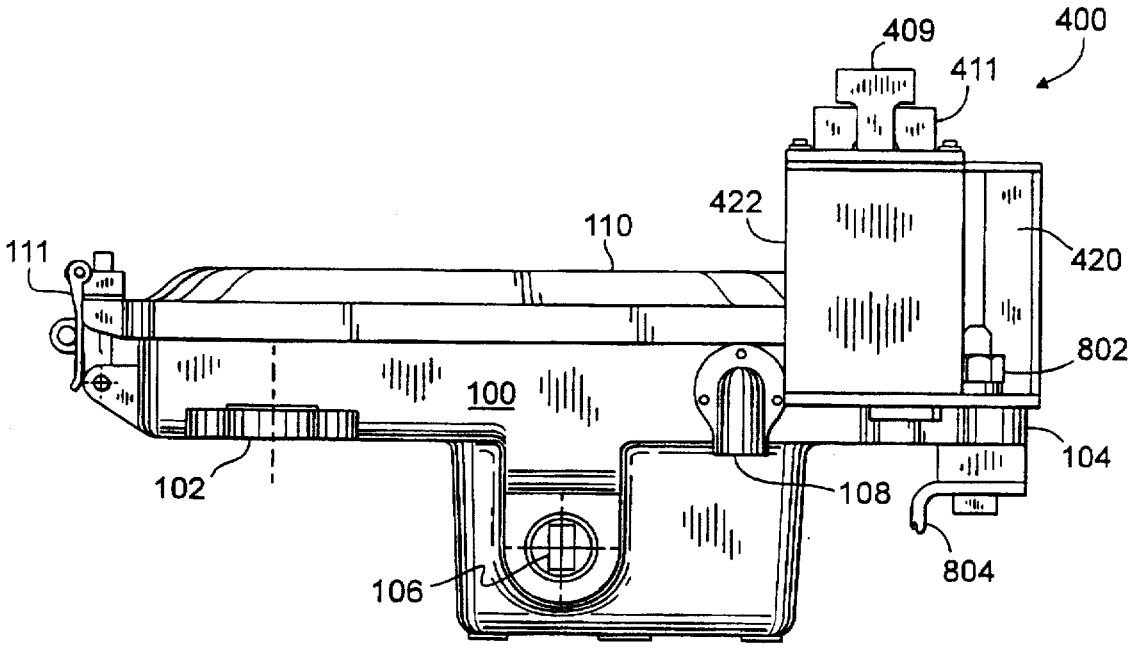
FIG. 8 is a side view of the latching device mounted with mounting hardware to a mounting lug of the train stop housing, in accordance with the present invention.
Figure 9:
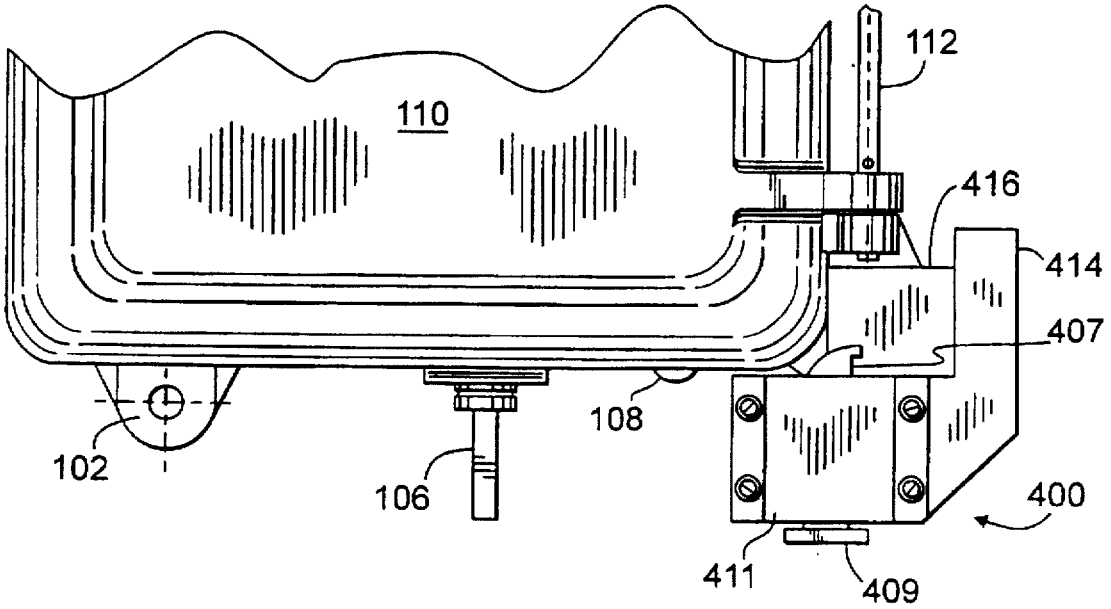
FIG. 9 is a top view of the mounted latching device of FIG. 8.
Figure 10:
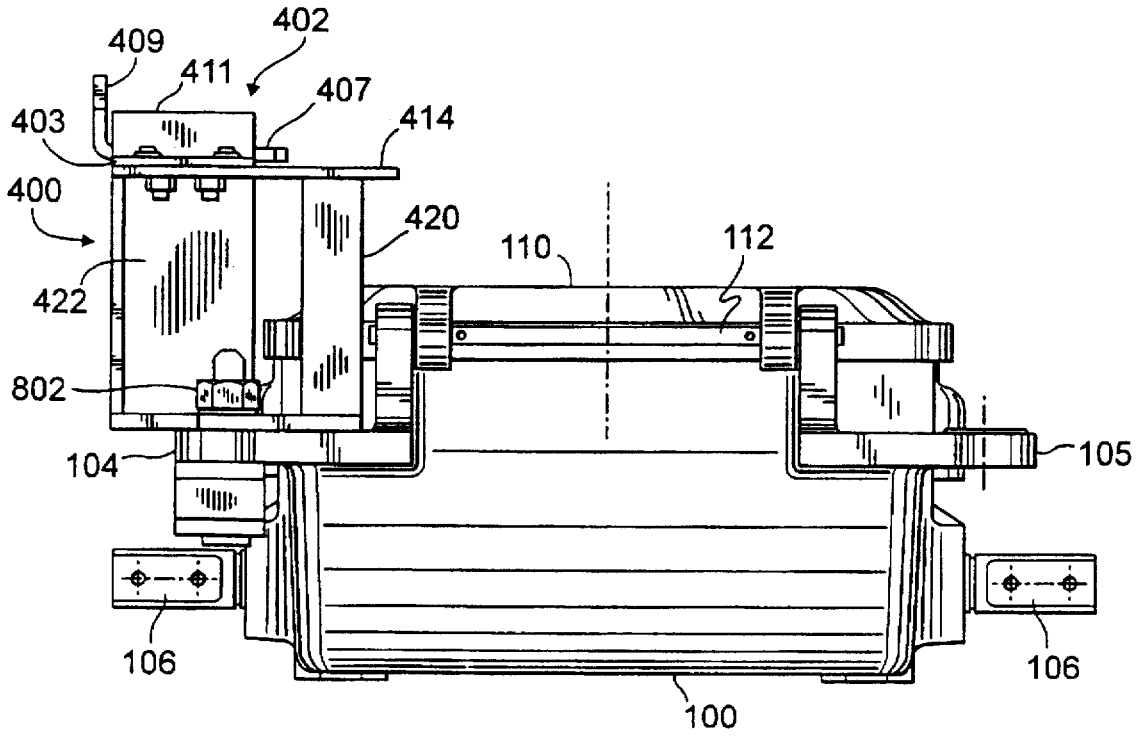
FIG. 10 is a rear view of the mounted latching device of FIG. 8.

In FIGS. 8, 9, 10, a side view, a cutaway top view, and a rear view, respectively, is shown of the latching device 400 mounted with mounting hardware 802 to the mounting lug 104 of the housing 100 so that the reinforced support portion 414 is positioned above the hinge pin 112 and the latch end 407 protrudes outwardly away from the cover 411 thereby to obstruct the closing of the door 110 when the door 110 is rotated about the hinge pin 112 to be positioned in an open position between the latch end 407 and the support portion 414. The door 110 is shown in the closed position atop the housing 100 in FIGS. 8–10. A preferred embodiment of the mounting hardware 802 is a 0.75 inch 19 centimeter) bolt inserted through the mounting lug 104 and into the mounting orifice 418 of the frame 401, and secured with a nut as is known in the art. In this manner, the latching device 400 with the appropriately oriented latch assembly 402 and support portion 414 may be mounted on any mounting lug of the housing 100, depending on the orientation of the hinge pin 112 on which the door 110 is hinged to the housing 100. In FIG. 8, a bench leg portion 804 is shown cut away to demonstrate that the latching device 400 may be mounted with the mounting hardware 802 through the mounting lug 104 and through the bench leg portion 804 which is part of the mounting bench bracket (not shown) on which the housing 100 is typically mounted as is well known in the art.

2. Operation of the Preferred Embodiment

Figure 11:
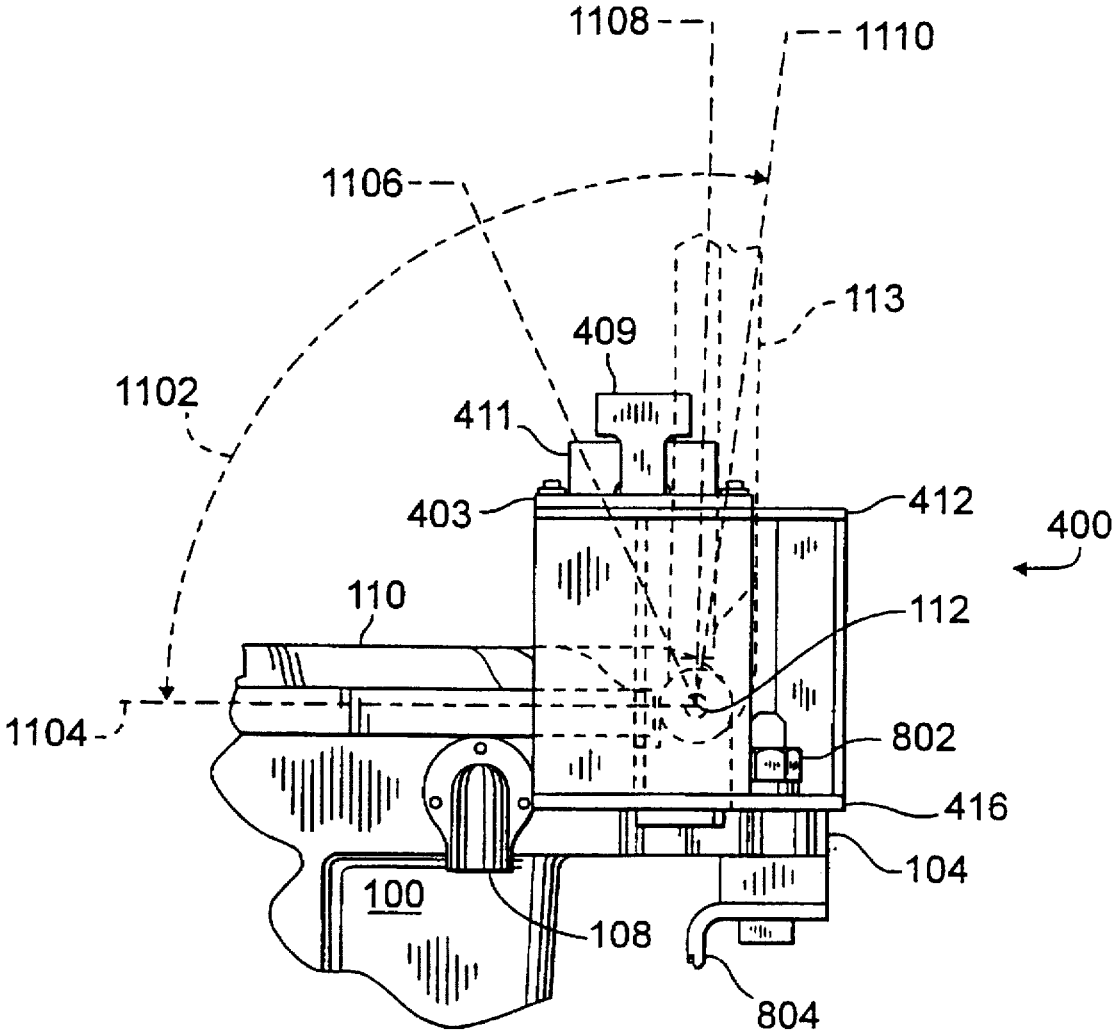
FIG. 11 is a partial isometric side view of the latching device in accordance with the present invention, showing the rotational arc and various positions of the hinged door.

In operation, as is shown in FIGS. 11–15, the latching device 400 is mounted with mounting hardware 802 to the mounting lug 104 of the housing 100 so that the support portion 414 is located above and behind the hinge pin 112 relative to the door 110. FIG. 11 shows a partial dotted line side view of a swing arc 1102 which shows the range of door swing movement from a closed position at a dotted line 1104 with the door positioned at zero degrees relative to the housing 100, to a partially open position at a dotted line 1106 when the door 110 is positioned at approximately 65 degrees relative to the housing 100, to a partially open position at a dotted line 1108 with the door 110 positioned at approximately 90 degrees relative to the door 110 as illustrated with the phantom door 113, and to a fully opened position at a dotted line 1110 when the door 110 is resting against the support portion 414 at approximately 97 degrees relative to the housing 100.

Figure 12:
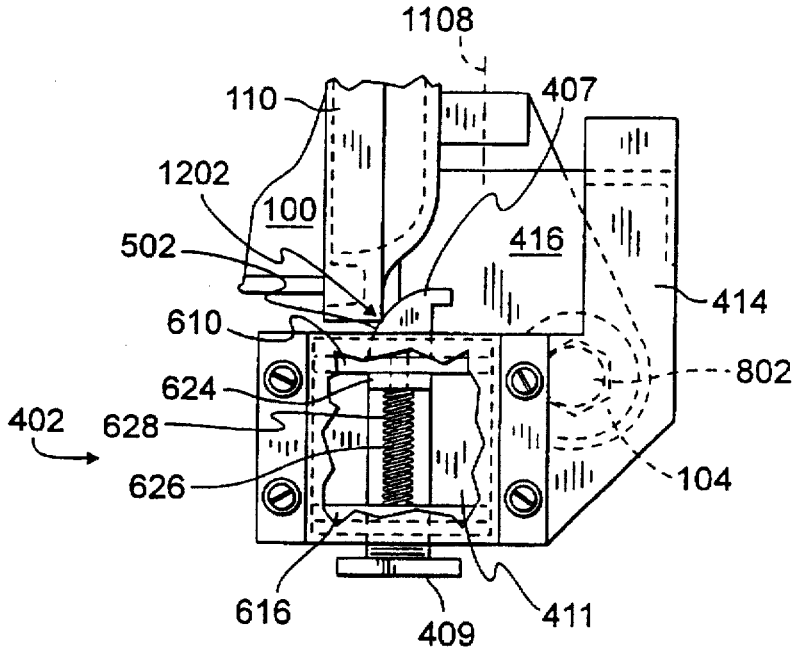
FIG. 12 is a top view of the latching device in accordance with the present invention, showing a cutaway view of the housing to which the latching device is mounted, and a cutaway view of a partially rotated door as the door first touches a latch end of the latching device.

Referring now to FIGS. 12–15, a top view is shown of the interaction between the latch end 407 and the handle end 409 with the door 110 as the door 110 is moved through the swing arc 1102 of FIG. 11. In FIG. 12, a door corner 1202 is just touching the rounded side 502 of the latch end 407 which is spring tensioned outwardly from the cover 411 and towards the door 110 by the spring 628. In this position, the handle end 409 is positioned close to the cover 411. In a preferred embodiment, the door corner 1202 of the door 110 just touches the rounded side 502 of the latch end 407 when the door 110 is positioned at the dotted line 1106 of FIG. 11 at approximately 65 degrees relative to the housing 100.

Figure 13:
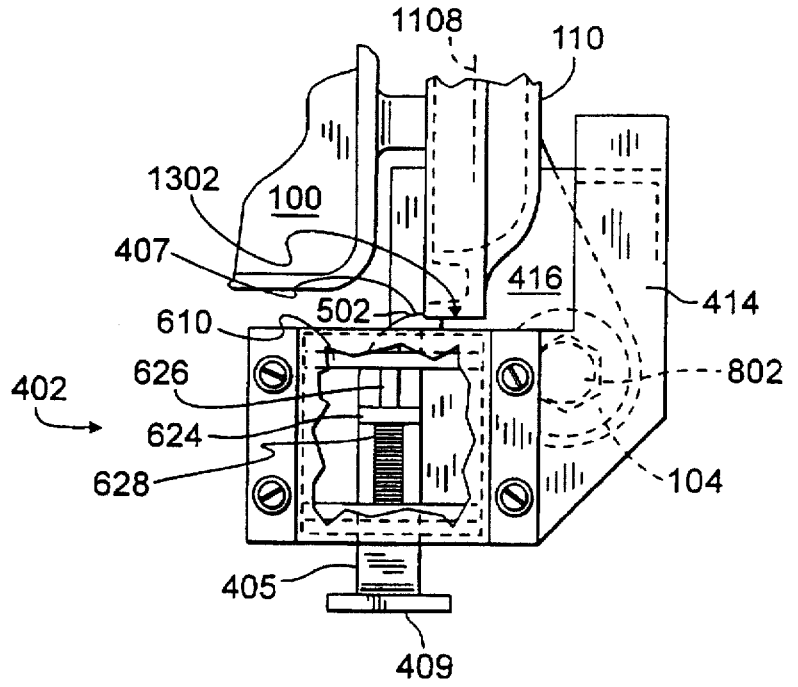
FIG. 13 is the top view of the latching device of FIG. 12, showing the door depressing the latch end into the latch assembly before the door clears the latch end to be positioned between the latch end and the reinforced support.

In FIG. 13, the door 110 has been moved to the dotted line 1108 and is positioned approximately 90 degrees relative to the housing 100. In this position, a door edge 1302 has slid alongside the rounded side 502 of the latch end 407 thereby to push the latch end 407 of the latching bar 405 towards and into the latch assembly 402, which compresses the spring 628 and moves the stop 624 away from the first bracket 610 and moves the handle end 409 outwardly away from the latch assembly 402. In FIG. 13, the door edge 1302 remains in contact with the latch end 407 thereby to retain the latch end 407 in a retracted position within the latch assembly 402.

Figure 14:
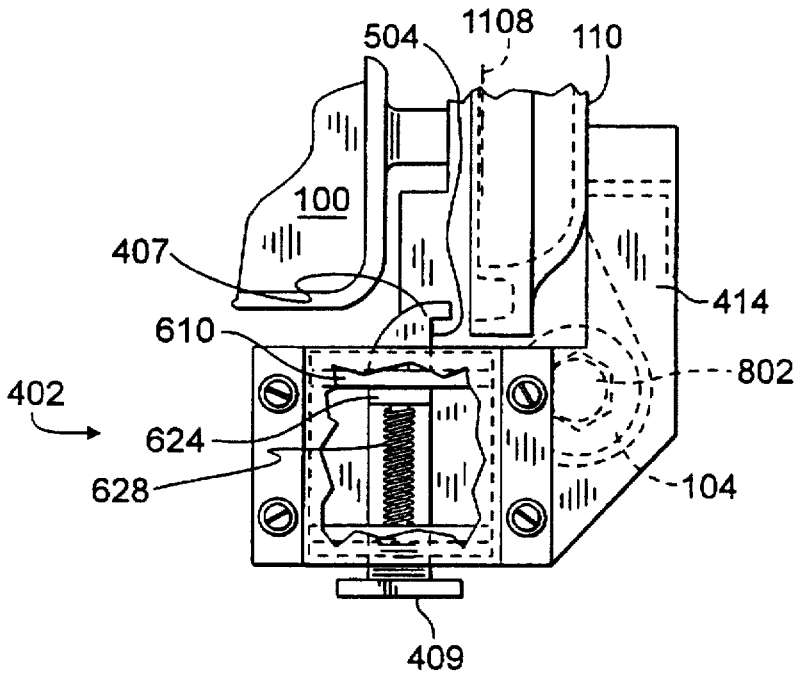
FIG. 14 is a top view of the latching device of FIG. 13, showing the door positioned between the latch end and the reinforced support.

In FIG. 14, a side view is shown of the door 110 positioned between the latch end 407 and the support portion 414 and resting against the support portion 414. In this position, the door 110 has been moved beyond the flat side 504 of the latch end 407, thereby permitting the spring 628 to urge the latch end 407 back outwardly away from the latch assembly 402 in a snapping motion which urges the stop 624 back against the first bracket 610. In a preferred embodiment, when the door 110 is resting against the support portion 414, the door 110 is positioned approximately 97 degrees relative to the housing 100, as shown by the dotted line 1110 in FIG. 11. When the latch end 407 is snapped outwardly from the latch assembly 402 by the compressed spring 628, the integral handle end 409 snaps inwardly towards the latch assembly 402.

Figure 15:
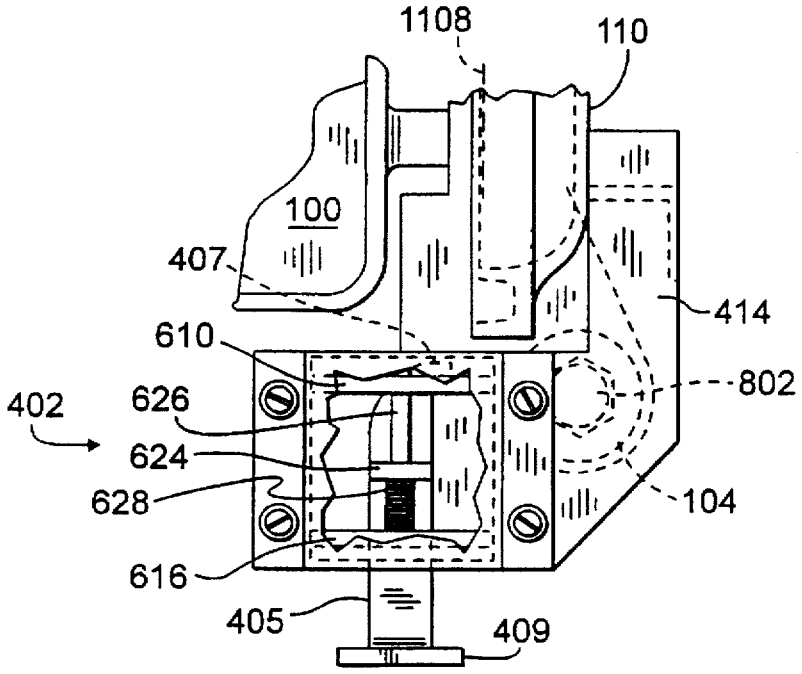
FIG. 15 is a top view of the latching device of FIG. 14, showing the handle end urged outwardly away from the latch assembly, thereby retracting the latch end into the latch assembly and providing clearance for the door to be moved away from the reinforced support and past the latch end to a closed position.

FIG. 15 shows the top view of FIG. 14 with the handle end 409 moved away from the latch assembly 402 against the tension of the spring 628, thereby compressing the spring 628, moving the stop 624 away from the first bracket 610, and retracting the latch end 407 into the latch assembly 402 to clear the latch end 407 obstruction in order to move the door 110 from the support portion 414 past the latch end 407 and towards the housing 100. In a preferred embodiment, the handle end 409 is grasped manually and pulled outwardly away from the latch assembly 402 in order to perform a manual and intentional unlatching motion to close the door. As long as the door 110 remains between the support portion 414 and the latch end 407 which protrudes from the latch assembly 402, then the door 110 is obstructed from being unintentionally or accidentally moved beyond the support portion 414 and beyond the latch end 407, thereby retaining the door 110 in an upright and open position and preventing the door from slamming shut towards the housing 100 while personnel is performing installation connections or operational maintenance to the inside of the housing 100.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A latching device for preventing unintentional closing of a door that is operatively attached to a train stop housing at a hinge in order that the door is pivotable at the hinge from a closed position to an open position, wherein the latching device comprises:

a latching assembly having a latching bar defining a latch end and a handle end, a first and second bracket defining a channel within which said latching bar operatively slides, and a spring mounted between said first and second bracket, such that said spring urges said latch end and said handle end together in a first direction;

frame means for mounting said latching assembly in a fixed position with respect to the train stop housing;

a door support, integral to said frame means, against which the hinged door rests in the open position; and wherein said latching assembly is mounted to said frame means thereby to releasably retain the door in the open position between said door support and said latch end, and wherein said handle end is movable against urging of the spring, thereby to retract said latch end in a second direction which opposes said first direction, in order to release the door for movement to the closed position.

2. The latching device according to claim 1, wherein said latch end further comprises:

a first side which faces said door support;

a second side which opposes said first side and faces away from said door support, wherein said second side is rounded thereby to slide alongside the door as the door is pivoted toward said door support and moved past said latch end to the open position, thereby urging said latch end to move in said second direction against urging of said spring.

3. The latching device according to claim 2, wherein said door support is reinforced to support the weight of a heavy cast iron door.

4. The latching device according to claim 1, wherein said door support is reinforced to support the weight of a heavy cast iron door.

5. A latching device for preventing unintentional closing of a door that is operatively attached to a train stop housing at a hinge in order that the door is pivotable at the hinge from a closed position to an open position, wherein the latching device comprises:

a latching assembly having a latching bar defining a latch end and a handle end, a first and second bracket defining a channel within which said latching bar operatively slides, and a spring mounted between said first and second bracket, such that said spring urges said latch end and said handle end together in a first direction;

frame means for mounting said latching assembly in a fixed position with respect to the train stop housing;

a door support, integral to said frame means, against which the hinged door rests in the open position;

wherein said latching assembly is mounted to said time means, thereby to releasably retain the door in the open position between said door support and said latch end, and wherein said handle end is movable against urging of the spring, thereby to retract said latch end in a second direction which opposes said first direction, in order to release the door for movement to the closed position; and wherein said frame means comprises a top portion;

a bottom portion;

at least one bracket affixed therebetween said top portion and said bottom portion, thereby to mount said releasable latch means a predetermined height above the hinge.

6. The latching device according to claim 5, wherein said bottom portion defines a mounting orifice for mounting of said frame means to the housing.

7. A latching device for preventing unintentional closing of a door that is operatively attached to a housing at a hinge in order that the door is pivotable at the hinge from a closed position to an open position, wherein the latching device comprises:

frame means, having an integral door support against which the door rests in the open position, for mounting the door support in a fixed position with respect to the housing; and latching assembly having a latching bar defining a latch end and a handle end, a first and second bracket defining a channel within which said latching bar operatively slides, and a spring mounted between said first and second bracket, such that said spring urges said latch end and said handle end together in a first direction, wherein said latching assembly is mounted to said frame means, thereby to releasably retain the door in the open position between said door support and said latch end, and wherein said handle end is movable against the spring urging to retract said latch end in a second direction which opposes said first direction, in order to release the door for movement to the closed position.

8. The latching device according to claim 7, wherein said integral door support is reinforced to support the weight of a heavy cast iron door.

9. A latching device for preventing unintentional closing of a door that is operatively attached to a housing at a hinge in order that the door is pivotable at the hinge from a closed position to an open position, wherein the latching device comprises:

frame means, having an integral door support against which the door rests in the open position, for mounting the door support in a fixed position with respect to the housing;

latching assembly having a latching bar defining a latch end and a handle end, a first and second bracket defining a channel within which said latching bar operatively slides, and a spring mounted between said first and second bracket, such that said spring urges said latch end and said handle end together in a first direction, wherein said latching assembly is mounted to said frame means, thereby to releasably retain the door in the open position between said door support and said latch end, and wherein said handle end is movable against the spring urging to retract said latch end in a second direction which opposes said first direction, in order to release the door for movement to the closed position; and wherein said frame means comprises:

a top portion;

a bottom portion;

at least one bracket affixed therebetween said top portion and said bottom portion, thereby to mount said releasable latch means a predetermined height above the hinge.

10. The latching device according to claim 9, wherein said bottom portion defines a mounting orifice for mounting of said frame means to the housing.

11. A latch apparatus for a door that is operatively attached to a housing at a hinge in order that the door is pivotable at the hinge from a closed position that covers an interior of the housing to an open position that exposes the interior of the housing, wherein the latch apparatus comprises:

releasable latch means fixedly mounted with respect to the housing, for releasably retaining the door in the open position; and wherein said releasable latch means comprises:

a bottom plate;

a latching bar having an integral latch end, an integral handle end and an integral stop;

bracket means affixed to said bottom plate, for retaining said latching bar, said bracket means defining a channel through which said latching bar operatively slides atop said bottom plate; and spring means for urging said stop in a first direction against said bracket means, wherein urging said integral handle end in a second direction which opposes said first direction, against said urging of said spring means, slides said latching bar within said channel and retracts said integral latch end.

12. A latch apparatus for a door that is operatively attached to a housing at a hinge in order that the door is pivotable at the hinge from a closed position that covers an interior of the housing to an open position that exposes the interior of the housing, wherein the latch apparatus comprises:

releasable latch means fixedly mounted with respect to the housing, for releasably retaining the door in the open position;

frame means for mounting said releasable latch means to the housing;

wherein said frame means comprises:

a top portion;

a bottom portion;

at least one bracket affixed therebetween said top portion and said bottom portion, thereby to mount said releasable latch means a predetermined height above the hinge.

13. The latch apparatus according to claim 12, wherein said bottom portion defines a mounting orifice for mounting of said frame means to the housing.

14. The latch apparatus according to claim 12, wherein said top portion defines a support structure against which the door is positioned when in the open position.

15. The latch apparatus according to claim 14, wherein said support structure is reinforced to support the weight of a heavy cast iron door.

* * * * *

UNITED STATES PATENT AND TRADEMARK OFFICE

CERTIFICATE OF CORRECTION

PATENT NO : 5,675,868

DATED : OCTOBER 14, 1997

INVENTOR(S) : Ross Edward Ferguson, Glen John Siefert, Mike Edward Sterling

It is certified that error appears in the above-identified patent and that said Letters Patent is hereby corrected as shown below:

Title page, left column, line 6, in Inventors section, change "Siefert" to --Seifert--.

Signed and Sealed this

Second Day of February, 1999

*Attest:*

*Attesting Officer*

*Acting Commissioner of Patents and Trademarks*